US011575197B2

(12) United States Patent
Wu et al.

(10) Patent No.: US 11,575,197 B2
(45) Date of Patent: Feb. 7, 2023

(54) MULTI-BAND ANTENNA HAVING PASSIVE RADIATION-FILTERING ELEMENTS THEREIN

(71) Applicant: CommScope Technologies LLC, Hickory, NC (US)

(72) Inventors: Runmiao Wu, Suzhou (CN); Changfu Chen, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 19 days.

(21) Appl. No.: 17/222,023

(22) Filed: Apr. 5, 2021

(65) Prior Publication Data

US 2021/0320413 A1 Oct. 14, 2021

(30) Foreign Application Priority Data

Apr. 10, 2020 (CN) ..... 202010277491.X

(51) Int. Cl.

| | |
|---|---|
| ***H01Q 1/52*** | (2006.01) |
| ***H01Q 5/45*** | (2015.01) |
| ***H01Q 1/24*** | (2006.01) |
| ***H01Q 19/10*** | (2006.01) |
| ***H01Q 25/00*** | (2006.01) |

(52) U.S. Cl.

CPC ..... *H01Q 1/523* (2013.01); *H01Q 1/246* (2013.01); *H01Q 5/45* (2015.01); *H01Q 19/10* (2013.01); *H01Q 25/001* (2013.01)

(58) Field of Classification Search

CPC ..... H01Q 1/246; H01Q 1/523; H01Q 5/45; H01Q 19/108; H01Q 25/001

See application file for complete search history.

(56) References Cited

U.S. PATENT DOCUMENTS

| | | | | |
|---|---|---|---|---|
| 2009/0096700 | A1* | 4/2009 | Chair | H01Q 1/246 343/797 |
| 2016/0254594 | A1 | 9/2016 | Jones et al. | |
| 2017/0310009 | A1* | 10/2017 | Isik | H01Q 21/062 |
| 2019/0273315 | A1 | 9/2019 | Hu et al. | |
| 2019/0372204 | A1 | 12/2019 | Varnoosfaderani et al. | |

FOREIGN PATENT DOCUMENTS

| | | | |
|---|---|---|---|
| WO | 2019084232 | A1 | 5/2019 |

OTHER PUBLICATIONS

"Communication with European Search Report", EP Application No. 21167655.6, Aug. 31, 2021, 11 pp.

* cited by examiner

*Primary Examiner* — Robert Karacsony
(74) *Attorney, Agent, or Firm* — Myers Bigel, P.A.

(57) ABSTRACT

A multi-band antenna includes a reflector, and a plurality of first radiating elements on the reflector. The plurality of first radiating elements are configured to radiate a first antenna beam(s) in a first frequency band responsive to at least one feed signal. A passive radiation-filtering element is provided, which extends proximate the first antenna beam(s). The passive radiation-filtering element includes at least one of a low-pass LC circuit, a band-pass LC circuit, and a high-pass LC circuit therein, which is configured to provide a lower frequency-dependent impedance to radiation within the first frequency band relative to radiation at frequencies outside the first frequency band. The passive radiation-filtering element may be configured as a multi-segment fence having capacitive and inductive elements therein, which are electrically coupled in series.

8 Claims, 8 Drawing Sheets

MULTI-BAND ANTENNA HAVING PASSIVE RADIATION-FILTERING ELEMENTS THEREIN

REFERENCE TO PRIORITY APPLICATION

This application claims priority to Chinese Patent Application No. 202010277491.X, filed Apr. 10, 2020, the disclosure of which is hereby incorporated herein by reference.

FIELD OF THE INVENTION

The present invention relates to communication systems and, more particularly, to multi-band antennas that are suitable for use in communication systems.

DESCRIPTION OF RELATED ART

Cellular communications systems are well known in the art. In a cellular communications system, a geographic area may be divided into a series of regions that are referred to as "cells" which are served by respective base stations. The base station may include one or more base station antennas that are configured to provide two-way radio frequency ("RF") communications with mobile subscribers that are located within the cell served by the base station.

In many cases, each base station is divided into "sectors". In perhaps the most common configuration, a hexagonally shaped cell is divided into three 120° sectors, and each sector is served by one or more base station antennas that have an azimuth Half Power Beam Width (HPBW) of approximately 65°. Typically, the base station antennas are mounted on a tower structure, with the radiation pattern (also referred to herein as "an antenna beam") that are generated by the base station antennas directed outwardly. Base station antennas are often implemented using a linear or planar phased arrays of radiating elements on an underlying reflector.

In order to increase system capacity, multi-band antennas are currently being deployed. However, when using multi-band antennas, RF elements, such as radiating elements and parasitic elements, may interact with each other in an undesired manner, and this interaction may adversely interfere with the radiation patterns of the radiating elements and, therefore, adversely impact the RF performance of the multi-band antennas.

SUMMARY OF THE INVENTION

A multi-band antenna according to some embodiments of the invention includes a reflector, and a first array of radiating elements having a plurality of first radiating elements therein that are configured to radiate a first antenna beam(s) in a first frequency band, on the reflector. A parasitic element is provided, which extends adjacent at least a portion of the first array of radiating elements. The parasitic element is configured to include at least one of a low-pass LC circuit, a band-pass LC circuit, and a high-pass LC circuit therein, which is configured to preferentially pass radiation at frequencies within the first frequency band to a greater extent relative to radiation at frequencies outside the first frequency band. The multi-band antenna may also include: (i) a second array of radiating elements having a plurality of second radiating elements therein that are configured to radiate a second antenna beam(s) in a second frequency band, on the reflector, and (ii) a third array of radiating elements having a plurality of third radiating elements therein that are configured to radiate a third antenna beam(s) in a third frequency band, on the reflector. In addition, the parasitic element may be configured to pass radiation at frequencies within the first frequency band to a greater extent relative to the radiation within the second and third frequency bands.

According to another embodiment of the invention, the parasitic element is configured as a radiation-filtering fence that extends along a side of the reflector. This radiation-filtering fence includes a plurality of spaced-apart sub-segments extending in series along a length thereof as capacitive and inductive elements that define at least one series LC circuit. This radiation-filtering fence may be capacitively coupled to the reflector, in some embodiments of the invention. The radiation-filtering fence may also include a series combination of at least two of: a low-pass LC circuit, a band-pass LC circuit, and a high-pass LC circuit therein, according to other embodiments of the invention. In some embodiments, the radiation-filtering fence includes a plurality of sub-segments extending in series along a length thereof as capacitive and inductive elements, which define a plurality of series LC circuits having different filtering characteristics.

A multi-band antenna according to another embodiment of the invention includes a reflector, and a plurality of first radiating elements on the reflector. The plurality of first radiating elements are configured to radiate a first antenna beam(s) in a first frequency band responsive to at least one radio frequency (RF) feed signal. A passive radiation-filtering element is also provided, which extends proximate the first antenna beam(s). The passive radiation-filtering element includes at least one of a low-pass LC circuit, a band-pass LC circuit, and a high-pass LC circuit therein, which is configured to provide a lower impedance to radiation within the first frequency band relative to radiation at frequencies outside the first frequency band. In some of these embodiments, the passive radiation-filtering element is configured as a multi-segment fence having capacitive and inductive elements therein, which are electrically coupled in series. This multi-segment fence may extend along a portion of the reflector, and may be capacitively coupled to the reflector. For example, the multi-segment fence may be configured as metal flange having an L-shaped cross-section, which is mounted on a forward-facing surface of the reflector. Accordingly, the passive radiation-filtering element may extend closer to a rear-facing surface of a first one of the plurality of first radiating elements relative to a forward-facing surface of the first one of the plurality of first radiating elements.

According to some of these embodiments of the invention, a first plurality of segments of the multi-segment fence may be configured as capacitive elements having air-gaps therebetween, a second plurality of segments of the multi-segment fence may be configured as capacitive elements having air-gaps therebetween, and a third plurality of segments of the multi-segment fence may be configured as capacitive elements having meandering-shaped inductive elements therebetween. This third plurality of segments may extend between the first plurality of segments and the second plurality of segments. In some further embodiments of the invention, the plurality of segments may be patterned as metallization layers on a printed circuit board.

BRIEF DESCRIPTION OF THE DRAWINGS

The accompanying drawings, which constitute a part of the specification, illustrate embodiments of the present invention and, together with the description, serve to explain the principles of the present invention.

Figure 1:
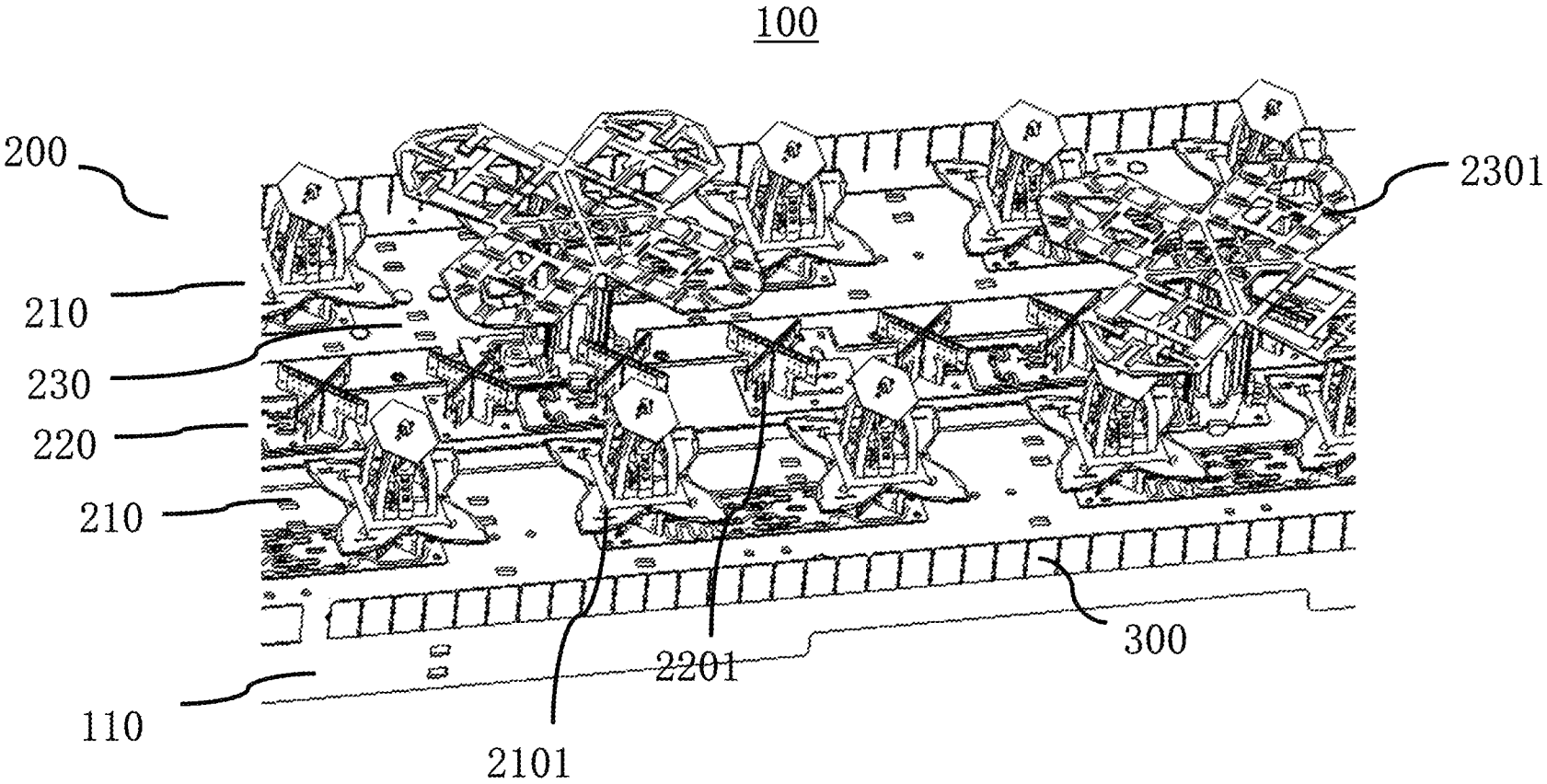
FIG. 1 is a perspective view schematically showing a portion of a multi-band antenna according to some embodiments of the present invention.

Note that, in some cases the same elements or elements having similar functions are denoted by the same reference numerals in different drawings, and description of such elements is not repeated. In some cases, similar reference numerals and letters are used to refer to similar elements, and thus once an element is defined in one figure, it need not be further discussed for following figures.

In order to facilitate understanding, the position, size, range, or the like of each structure illustrated in the drawings may not be drawn to scale. Thus, the present invention is not necessarily limited to the position, size, range, or the like as disclosed in the drawings.

DETAILED DESCRIPTION OF EMBODIMENTS

The present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. It should also be understood that the embodiments disclosed herein can be combined in various ways to provide many additional embodiments.

It should be understood that the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

Herein, the foregoing description may refer to elements or nodes or features being "coupled" together. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

In the specification, words describing spatial relationships such as "up", "down", "left", "right", "forward", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

The term "A or B" used through the specification refers to "A and B" and "A or B" rather than meaning that A and B are exclusive, unless otherwise specified. The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the preceding technical field, background, summary or detailed description.

Herein, the term "substantially" is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation. In this context, the term "at least a portion" may be a portion of any proportion, for example, may be greater than 10%, 20%, 30%, 40%, 50%, 60%, 70%, 80%, or 90%, for example.

In addition, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise/include", as used herein, specify the presence of stated features, steps, operations, elements, and/or components, but do not preclude the presence or addition of one or more other features, steps, operations, elements, components, and/or groups thereof. In a multi-band antenna, radiating elements of different frequency bands may interact with each other in an undesired manner and/or parasitic elements and radiating elements may interact with each other in an undesired manner. For example, when the radiating elements of first frequency band and/or the parasitic elements for the radiating elements of first frequency band resonate in a second frequency band, undesired interference may occur to radiating elements in the second band. This kind of undesired interaction may cause distortion of respective radiation patterns of the radiating elements of second frequency band, such as the presence of recesses in the radiation pattern, changes in an azimuth beam width, large beam squint, highly cross-polarized radiation, or the like. The multi-band antenna according to embodiments of the present invention may reduce at least some of the above-mentioned undesired interactions while maintaining the original function of the parasitic element.

Figure 2:
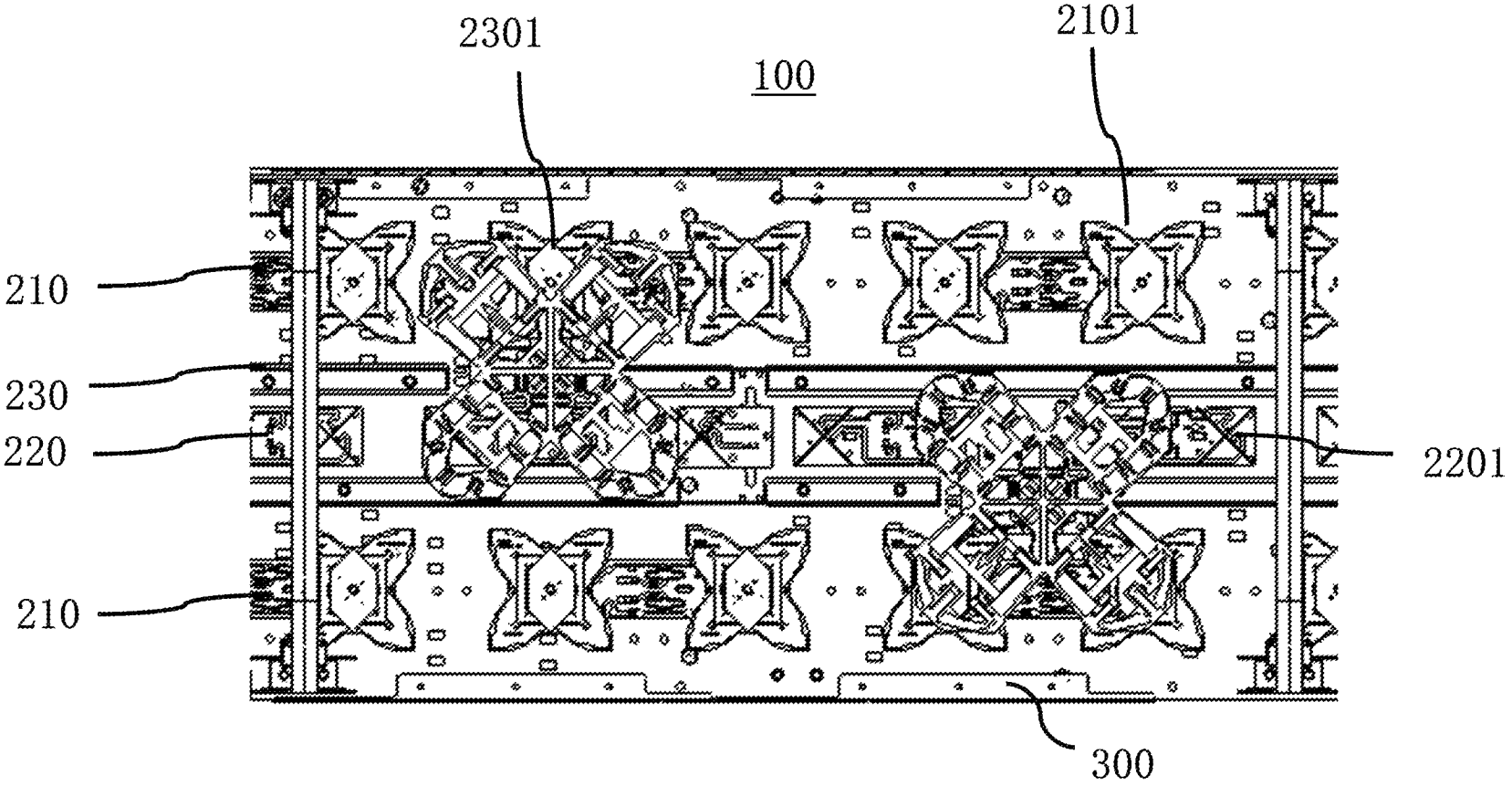
FIG. 2 is a front view schematically showing the portion of the multi-band antenna in FIG. 1.
Figure 3:
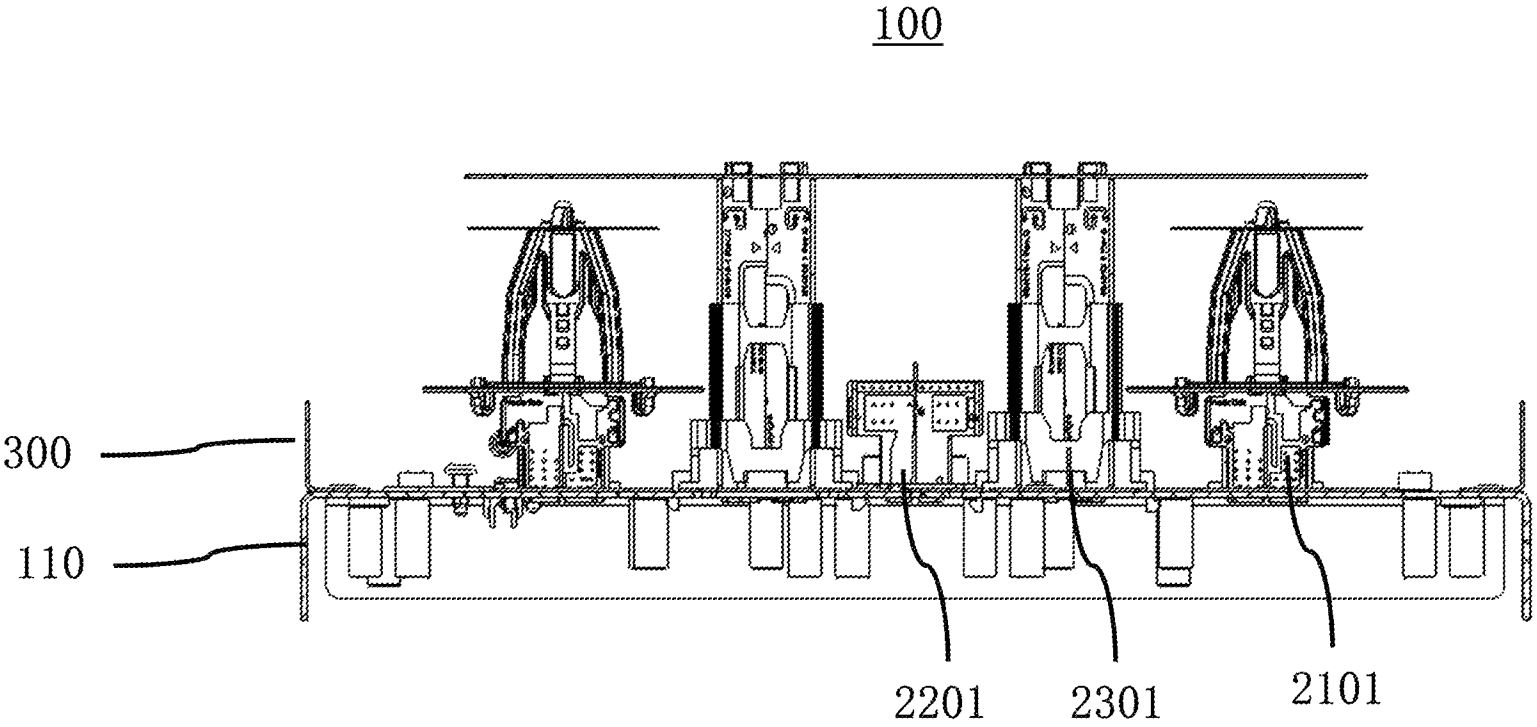
FIG. 3 is a side view schematically showing the portion of the multi-band antenna in FIG. 1.

Embodiments of the present invention will now be described in more detail with reference to the accompanying drawings. Referring now to FIGS. 1 to 3, FIG. 1 is a perspective view schematically showing a portion of a multi-band antenna 100 according to some embodiments of the present invention, FIG. 2 is a front view schematically showing the portion of the multi-band antenna 100 in FIG. 1, and FIG. 3 is a side view schematically showing the portion of the multi-band antenna 100 in FIG. 1.

The multi-band antenna 100 may be mounted on a raised structure, such as antenna towers, utility poles, buildings, water towers and the like, with its longitudinal axis extending substantially perpendicular to the ground for convenient operation. The antenna 100 is usually mounted within a radome (not shown) that provides environmental protection. The multi-band antenna 100 includes a reflector 110. The reflector 110 may include a metal surface that provides a ground plane and reflects electromagnetic waves reaching it, for example, redirecting the electromagnetic waves for forward propagation. The antenna 100 further includes mechanical and electronic components, such as a connector, a cable, a phase shifter, a remote electronic tilt (RET) unit, a duplexer and the like, which are disposed on a rear side of the reflector 110.

As shown in FIG. 1, the multi-band antenna 100 may further include an antenna array 200 disposed on a front side of the reflector 110. The antenna array 200 may include an array or arrays 210 of first radiating elements, an array or arrays 220 of second radiating elements, and an array or arrays 230 of third radiating elements. In the current embodiment, the operating frequency band of the first radiating element 2101 (hereinafter also referred to as a V-band radiating element) may be, for example, V band (1695-2690 MHz) or sub-bands thereof (for example, H band (1695-2200 MHz), T band (2200-2690 MHz), or the like). The operating frequency band of the second radiating element 2201 (hereinafter, also referred to as an S-band radiating element) may be, for example, S band (3.1-4.2 GHz) or sub-bands thereof. The operation frequency band of the third radiating element 2301 (hereinafter also referred to as an R-band radiating element) may be, for example, R band (694-960 MHz) or sub-bands thereof. The V-band radiating element may be configured to generate a first antenna beam in the V band or a portion thereof, the S-band radiating element may be configured to generate a second antenna beam in the S band or a portion thereof, and the R-band radiating element may be configured to generate a third antenna beam in the R band or a portion thereof.

Referring to FIG. 3, the third radiating element 2301 may extend farther forward from the reflector 110 than the first radiating element 2101, and the first radiating element 2101 may extend farther forward from the reflector 110 than the second radiating element 2201. The multi-band antenna 100 may be configured as a so-called RVVSS antenna. That is, there are provided two arrays 210 of first radiating elements 2101 (V), two arrays 220 of second radiating elements 2201 (S) and one array 230 of third radiating elements 2301 (R). The two arrays 210 of first radiating elements 2101 are spaced from each other in a horizontal direction, and the two arrays 220 of second radiating elements 2201 are spaced from each other in a vertical direction. At least some of the third radiating elements 2301 in the array 230 of third radiating elements 2301 may be distributed in a staggered manner (e.g., zig-zag) so as to obtain an antenna beam with a narrower beam width in the azimuth plane. It should be understood that the multi-band antenna according to embodiments of the present invention may be any type of multi-band antennas and is not limited to the RWSS antenna. Some embodiments of the present invention will be described below with RWSS antennas as an example.

The multi-band antenna 100 may further include a parasitic element 300 extending forward from the reflector 110. Various types of parasitic elements 300 may be provided in the multi-band antenna 100. For example, some parasitic elements may be provided as isolators, which extend between adjacent radiating elements and operate to increase the isolation (and reduce the coupling interference) between the adjacent radiating elements. Some parasitic elements 300 may be provided as fences, which are arranged around the antenna array 200 and interact with radiating elements. For example, during operation, a parasitic element 300 may absorb radio waves emitted from the radiating elements and radiate the radio waves outward again in a different phase in order to adjust the pattern of the antenna beam, such as to adjust the azimuth beam width, the front-to-back ratio and/or a cross-polarization ratio of the pattern.

The multi-band antenna 100 according to some embodiments of the present invention is provided with arrays of parasitic elements 300 including a plurality of parasitic elements 300 that may be disposed around the antenna array 200 and/or between the adjacent arrays of radiating elements. In some embodiments, these parasitic elements 300 may be used advantageously for the arrays 210 of V-band radiating elements. For example, these parasitic elements 300 may be configured to reduce the azimuth beam width of the pattern of the first antenna beam. These parasitic elements 300 may also be configured to increase the front-to-back ratio and/or a cross-polarization ratio of the pattern of the first antenna beam.

In some embodiments, these parasitic elements 300 may not only be used for the arrays 210 of V-band radiating elements but also for the arrays 230 of R-band radiating elements 2301. These parasitic elements 300 may be configured to reduce the azimuth beam width of the pattern of the first antenna beam and the third antenna beam. These parasitic elements 300 may also be configured to increase the front-to-back ratio and/or a cross-polarization ratio of the pattern of the first antenna beam and/or the third antenna beam. In some further embodiments, these parasitic elements 300 may be alternatively or additionally used for the arrays 220 of S-band radiating elements 2201. These parasitic elements 300 may be configured to increase the front-to-back ratio and/or a cross-polarization ratio of the pattern of a portion of the second antenna beam.

However, during operation of the multi-band antenna 100, the parasitic elements 300 may also bring about some negative effects in addition to the above-mentioned possible positive effect. For example, in some cases, these parasitic elements 300, based on their current distributions, may cause distortion in radiation pattern of the array of S-band radiating elements, for example, local presence of recesses in the pattern, large beam squint, high cross polarization or the like. This possible distortion may occur in any one or more sub-bands of the S-band, such as in the sub-bands of 3.1-3.3 GHz, 3.5-3.7 GHz, and/or 3.9-4.1 GHz. This undesirable negative effect may be exacerbated with the increased reflection of electromagnetic waves within the S band by the radome. Furthermore, in some cases, these parasitic elements 300, based on their current distributions, may cause distortion in a pattern of the array of S-band radiating elements and in a pattern of the array of R-band radiating elements.

In order to reduce this undesirable negative effect, the RF performance of the parasitic elements 300 needs to be changed so as to adjust the current distribution thereon, such as the distribution of current in the sub-band where distortion occurs, to thereby reduce the negative effect of the parasitic element 300 while maintaining its positive effect as much as possible. Next, two exemplary design solutions of the parasitic element 300 in the multi-band antenna 100 according to some embodiments of the present invention will be described in detail with reference to FIGS. 4*a*, 4*b*, 5*a*, 5*b* and 5*c*.

Figure 4A:
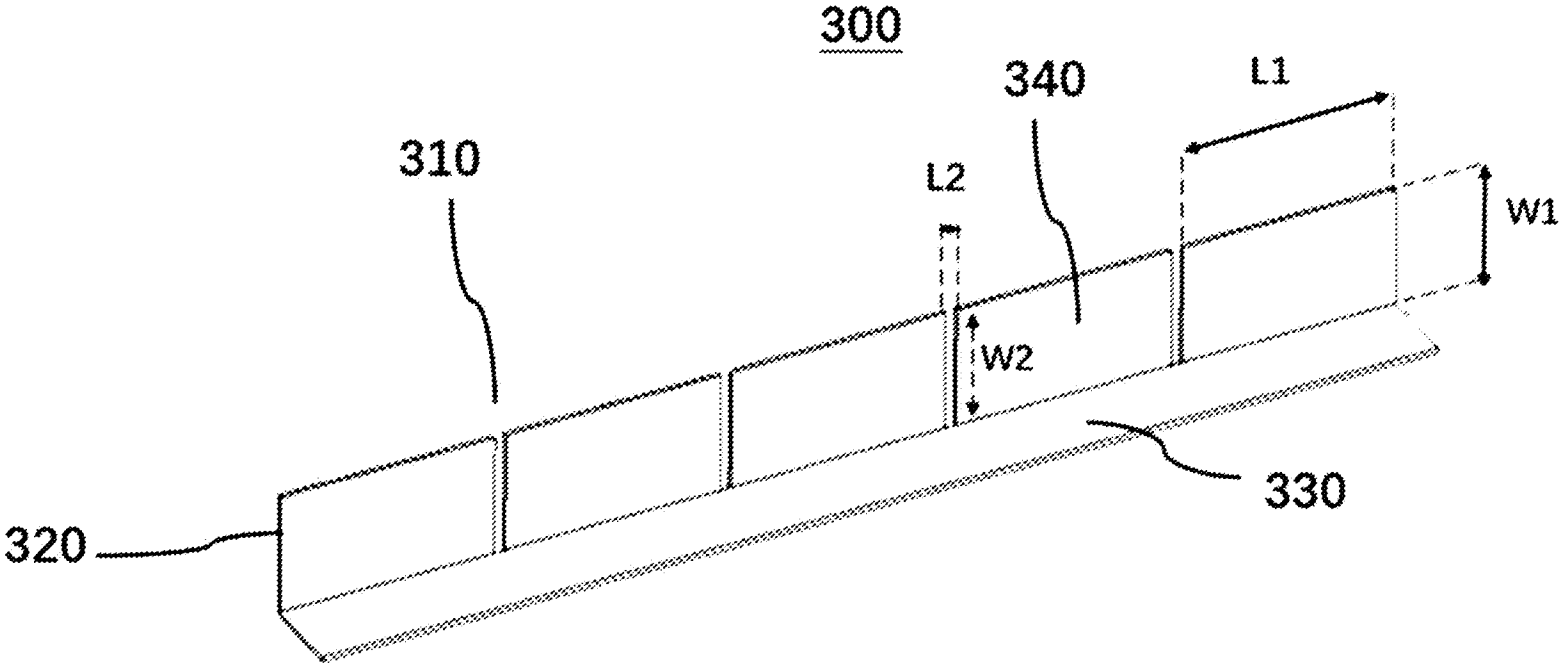
FIG. 4*a* schematically shows a first design solution of a parasitic element according to some embodiments of the present invention.

Referring to FIG. 4*a*, which schematically shows a first design solution of the parasitic element 300 according to some embodiments of the present invention. The parasitic element 300 is configured as a metal element or a sheet metal element, such as an aluminum parasitic element or a copper parasitic element. The metal parasitic element 300 may bring about a series of advantages: first, the metal parasitic element is typically more cost-effective; second, the metal parasitic element can be of any desired thickness; third, the metal parasitic element can have a low level of surface roughness and can exhibit improved passive intermodulation ("PIM") distortion performance.

As shown in FIG. 4*a* and FIG. 3, the parasitic element 300 may be configured as a metal element (e.g., metal flange/fence) with slots 310. The parasitic element 300 may include a first segment 320 and a second segment 330. The second segment 330 may be bent with respect to the first segment 320. The first segment 320 is divided into a plurality of sub-segments 340 by the slots 310. The second segment 330 (e.g., base) is configured to be mounted along a side edge of the reflector 110 of the multi-band antenna 100. For example, the parasitic element 300 may be mounted on the reflector 110 by means of bayonet connection, screw connection, rivet connection, welding, and/or bonding. In the embodiment of FIG. 4*a*, the second segment 330 may be capacitively coupled to the reflector 110.

Each slot 310 may extend over 50%, 60%, 70%, 80%, or 90% of the width of the first segment 320. Each slot 310 may even extend over the entire width up to the second segment 330. The sub-segments 340 are at least partially isolated from each other by the slots 310. Each of the sub-segments 340 of the parasitic element 300 may function as a capacitive element, and each of the slots 310 may function as an inductive element. The slots 310 may change the RF performance of the parasitic element 300, so as to adjust the current distribution on the parasitic element 300, particularly adjust the distribution of current in the sub-band where distortion occurs. The change in current distribution of the parasitic element 300 brought by the introduction of the slots 310 enables a reduction in negative effect of the parasitic element 300 while maintaining its positive effect.

Referring to FIG. 4*a*, the length of a sub-segment 340 is represented by L1, and the width thereof is represented by W1. The length of a slot 310 is represented by L2, and the width thereof is represented by W2. In the embodiment of FIG. 4*a*, the slot 310 extends substantially over the entire width up to the second segment 330, which means that W2 is approximately equal to W1. It should be understood that the individual slots 310 and/or the sub-segments 340 may have different lengths and/or widths.

As an example, and in some cases, these parasitic elements 300, based on their current distribution, may cause distortion in a pattern of the second antenna beam in the sub-band of 3.1-3.3 GHz. Therefore, the structure of the parasitic element 300 needs to be designed for this sub-band. For example, a design frequency (such as 3.2 GHz) may be selected, and each sub-segment 340 may have a length between ¼ and ½ of the wavelength corresponding to this design frequency 3.2 GHz. The width of the slot 310 may be smaller than, for example, 3 mm, 2 mm, 1 mm, or 0.5 mm. Each slot 310 is located between two sub-segments 340 to form an LC series circuit. The LC series circuit may function as an LC low pass circuit and may be configured to at least partially block a current within the corresponding sub-band (3.1-3.3 GHz), for example, the current flowing along the length of the first segment 320, thereby changing the distribution of a current within the corresponding sub-band (3.1-3.3 GHz) of the second frequency band on the parasitic element 300 and at least partially compensating for distortion in the pattern of the second antenna beam.

As an example, in some cases, these parasitic elements 300 may be configured to be substantially invisible to the second antenna beam. In other words, the slots 310 of the parasitic elements 300 may act as high impedance portions that interrupt currents in the S-band frequency range that could otherwise be induced on themselves. In this way, the slot 310 can reduce induced S-band currents on the parasitic element 300, thereby further reducing the scattering effect of the parasitic element 300 on the S-band radiating element. The parasitic element 300 with the slots 310 may make the parasitic element 300 almost invisible to the S-band radiating element, so that the parasitic element 300 has a cloaked function for the second antenna beam.

Figure 4B:
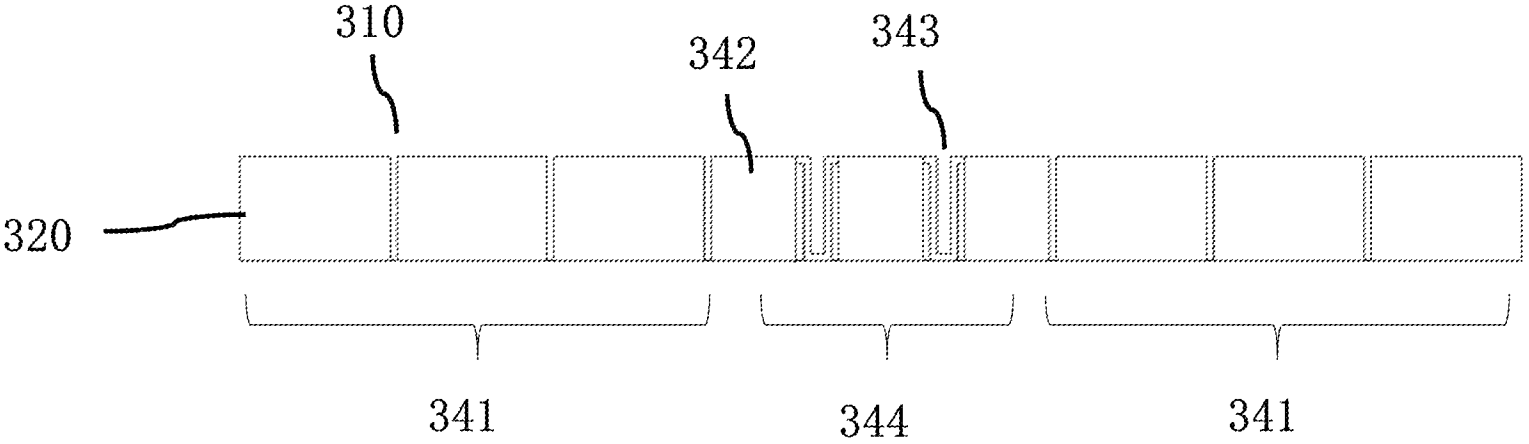
FIG. 4*b* schematically shows a variation of the parasitic element in FIG. 4*a;*

Referring to FIG. 4*b*, which schematically shows a variation of the first design solution of the parasitic element 300 according to some embodiments of the present invention. In FIG. 4*b*, only the first segment 320 of the parasitic element 300 is schematically shown. The second segment (not shown) may be identical to the second segment 330 of the embodiment of FIG. 4*a* that is discussed above. Different from FIG. 4*a*, the first segment 320 in FIG. 4*b* includes at least one LC low-pass circuit 341 composed of at least one slot 310 and at least one sub-segment 340 and at least one LC series circuit 344 composed of at least one wide sub-segment 342 and at least one meandered narrower sub-segment 343.

The LC low-pass circuit 341 may be configured such that the at least a portion of the first frequency band is within a passband of the LC low-pass circuit 341, and the at least a portion of the second frequency band is within a stopband of the LC low-pass circuit 341. And, in some embodiments, the LC series circuit 344 may be configured as an LC high-pass circuit such that the at least a portion of the first frequency band is within a passband of the LC high-pass circuit and the at least a portion of the third frequency band is within a stopband of the LC high-pass circuit.

In some embodiments, the LC series circuit 344 may be configured as an LC band-pass circuit, and the LC band-pass circuit is configured such that the at least a portion of the first frequency band is within a passband of the LC band-pass circuit, the at least a portion of the second frequency band and the at least a portion of the third frequency band is within a stopband of the LC band-pass circuit.

By means of the above-mentioned variation, the parasitic elements 300 may at least partially compensate for distortion in the pattern of the second antenna beam and distortion in the pattern of the third antenna beam. In some embodiments, the parasitic elements 300 may be configured to be substantially invisible to the second antenna beam and the third antenna beam. And, it should also be understood that the size, number, shape, and location of the slots 310 and/or sub-segments 340 on the parasitic element 300 may be designed into different forms according to actual conditions. For example, the equivalent inductance may be changed by adjusting the width and/or depth of the slot 310, and/or the equivalent capacitance may be changed by adjusting the width and/or length of the sub-segment 340, thereby changing the RF performance such as the resonance characteristic or filtering characteristic of the parasitic element.

Figure 5A:
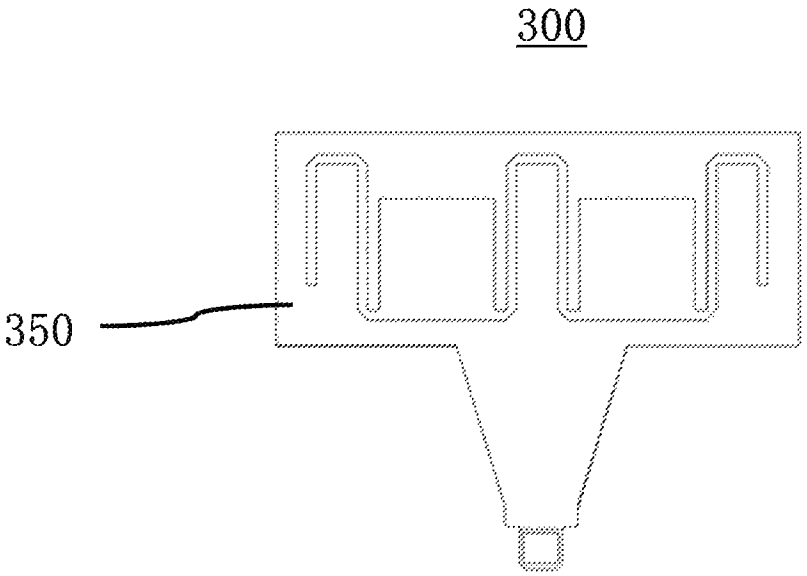
FIGS. 5*a* and 5*b* schematically show a second design solution of the parasitic element according to some embodiments of the present invention.
Figure 5B:
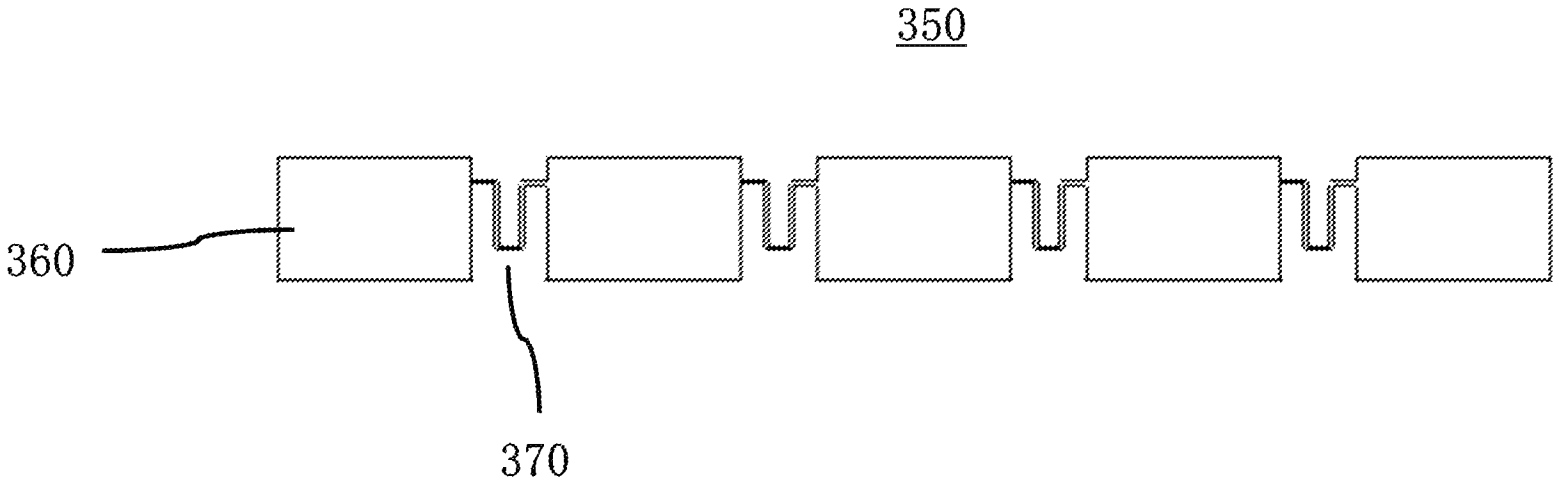

Referring to FIGS. 5*a* and 5*b*, a second design solution of the parasitic element 300 according to some embodiments of the present invention is schematically shown. The parasitic element 300 may be configured as a printed circuit board (PCB) element. The PCB-based parasitic element 300 may provide a number of advantages because: (i) it is easy to print various forms of electrically-conductive segments on the PCB, and (ii) the electrically-conducting segments may be flexibly achieved in diverse forms, which means they may well adapt to the actual application situations. Further, technicians may simulate various forms of the electrically-conductive segments at the beginning of the design so as to perform a preliminary test on the function of the electrically-conducting segments and then make a flexible modification based on the test result.

Each PCB element may have a printed metal pattern 350 on its side facing the antenna array 200, and the metal pattern 350 may include a wider trace segment 360 and a meandered narrower trace segment 370. Each wider trace segment 360 may function as a capacitive element, and each narrower trace segment 370 may function as an inductive element. The narrower trace segment 370 and the wider trace segment 360 can change the RF performance of the parasitic element 300, so as to adjust the current distribution on the parasitic element 300, particularly to adjust the distribution of current in the sub-band where distortion occurs. The resultant change in distribution of current enables a reduction in negative effect of the parasitic element 300 while maintaining the positive effect of the parasitic element 300. In the embodiment of FIGS. 5*a* and 5*b*, the metal pattern 350 may be electrically floating. In other embodiments, the metal pattern 350 may be also capacitively coupled to the reflector.

As an example, in some cases, these parasitic elements 300, based on their current distribution, may cause distortion in the pattern of the second antenna beam in the sub-band of 3.1-3.3 GHz. Therefore, the structure of the parasitic element 300 needs to be designed for this sub-band. For example, 3.2 GHz may be selected as a reference frequency, and each wider trace segment 360 may have a length between ¼ and ½ of the wavelength corresponding to 3.2 GHz. Each narrower trace segment 370 is located between two wider trace segment 360 to form an LC series circuit. The LC series circuit may function as an LC low pass circuit and may be configured to at least partially block a current within the corresponding sub-band (3.1-3.3 GHz), for example, the current flowing along the length of the metal pattern 350, thereby changing the distribution of a current within the corresponding sub-band (3.1-3.3 GHz) of the second frequency band on the parasitic element 300 and at least partially compensating for distortions in the pattern of the second antenna beam.

As an example, in some cases, these parasitic elements 300 may be configured to be substantially invisible to the second antenna beam. In other words, the narrower trace segments 370 of the parasitic elements 300 may act as high impedance portions that interrupt currents in the S-band frequency range that could otherwise be induced on the parasitic elements 300. As such, the narrower trace segment 370 may reduce induced S-band currents on the parasitic element 300, thereby further reducing the scattering effect of the parasitic element 300 on the S-band radiating element. The parasitic element 300 with the narrower trace segment 370 may make the parasitic element 300 almost invisible to the S-band radiating element, so that the parasitic element 300 has a cloaked function for the second antenna beam.

Figure 5C:
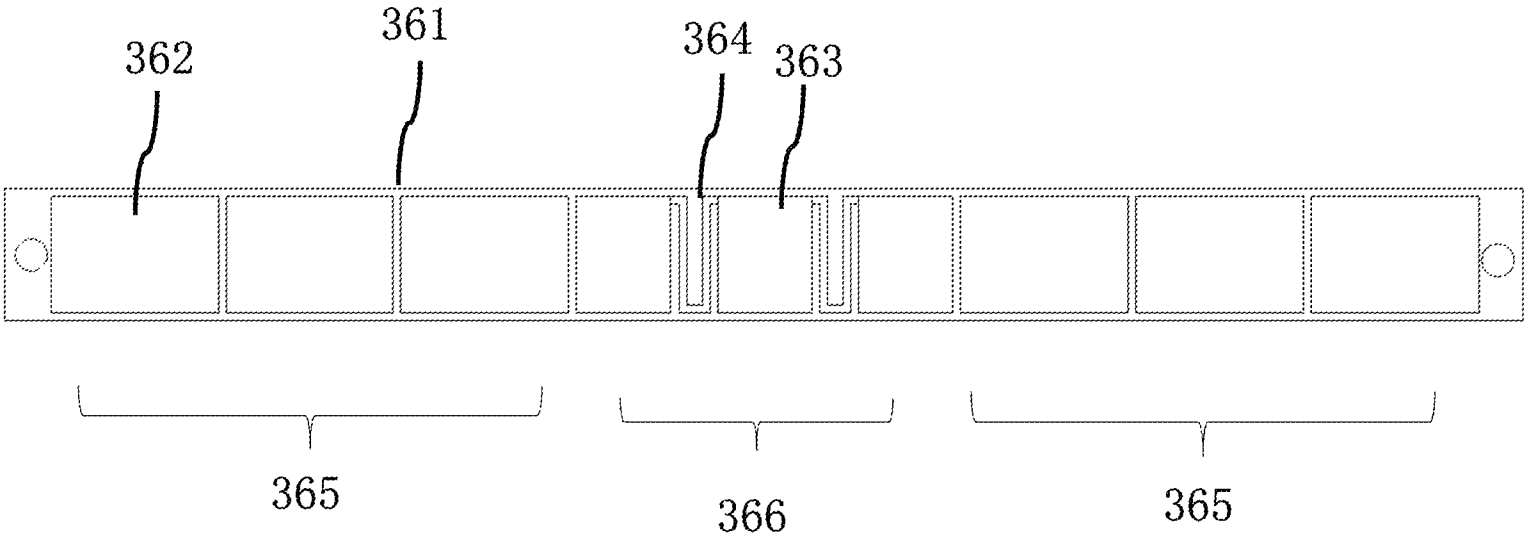
FIG. 5*c* schematically shows a variation of the parasitic element in FIGS. 5*a* and 5*b*.

Referring to FIG. 5*c*, which schematically shows a variation of the second design solution of the parasitic element 300 according to some embodiments of the present invention. In FIG. 5*c*, merely the metal pattern 350 of the parasitic element 300 is schematically shown. Different from FIGS. 5*a* and 5*b*, the metal pattern 350 in FIG. 5*c* includes at least one LC low-pass circuit 365 composed of at least one slot 361 and at least one sub-segment 362 and at least one LC series circuit 366 composed of at least one wide sub-segment 363 and at least one meandered narrower sub-segment 364.

The LC low-pass circuit 365 may be configured such that the at least a portion of the first frequency band is within a passband of the LC low-pass circuit 365, and the at least a portion of the second frequency band is within a stopband of the LC low-pass circuit 365. In addition, in some embodiments, the LC series circuit 366 may be configured as an LC high-pass circuit may be configured such that the at least a portion of the first frequency band is within a passband of the LC high-pass circuit, and at least a portion of the third frequency band is within a stopband of the LC high-pass circuit.

And, in some other embodiments, the LC series circuit 366 may be configured as an LC band-pass circuit, and the LC band-pass circuit is configured such that the at least a portion of the first frequency band is within a passband of the LC band-pass circuit, at least a portion of the second frequency band and at least a portion of the third frequency band is within a stopband of the LC band-pass circuit.

By means of the multiple above-mentioned variations, the parasitic elements 300 may at least partially compensate for distortion in the pattern of the second antenna beam and distortion in the pattern of the third antenna beam. In some embodiments, the parasitic elements 300 may be configured to be substantially invisible to the second antenna beam and the third antenna beam.

It should be understood that the size, number, shape, and location of the wider trace segment 360, 363, the narrower trace segment 370, 364, the slots 361 and the sub-segments 362 on the parasitic element 300 may be designed into different forms according to specific situations. For example, the equivalent inductance and/or the equivalent capacitance may be changed by adjusting the size of the narrower trace segment 370 and/or the wider trace segment 360, thereby changing the RF performance such as resonance characteristics or filtering characteristics of the parasitic element.

Accordingly, as described hereinabove and illustrated by FIGS. 1-5, a multi-band antenna 100 according to some embodiments of the invention includes a reflector 110, and a first array of radiating elements 210 having a plurality of first radiating elements 2101 therein that are configured to radiate a first antenna beam(s) in a first frequency band, on the reflector 110. A parasitic element (e.g., 300) is provided, which extends adjacent at least a portion of the first array of radiating elements. The parasitic element 300 is configured to include at least one of a low-pass LC circuit, a band-pass LC circuit, and a high-pass LC circuit therein, which is configured to preferentially pass radiation at frequencies within the first frequency band to a greater extent relative to radiation at frequencies outside the first frequency band. The multi-band antenna 100 may also include: (i) a second array of radiating elements 220 having a plurality of second radiating elements 2201 therein that are configured to radiate a second antenna beam(s) in a second frequency band, on the reflector, and (ii) a third array of radiating elements 230 having a plurality of third radiating elements 2301 therein that are configured to radiate a third antenna beam(s) in a third frequency band, on the reflector. In addition, the parasitic element 300 may be configured to pass radiation at frequencies within the first frequency band to a greater extent relative to the radiation within the second and third frequency bands.

As shown by FIGS. 1-3 and 4*a*-4*b* and 5*a*-5*c*, the parasitic element 300 is configured as a radiation-filtering fence 300 that extends along a side of the reflector 110. This radiation-filtering fence 320/330 includes a plurality of spaced-apart sub-segments 340 extending in series along a length thereof as capacitive elements and inductive elements 310 (e.g., air gaps) that define at least one series LC circuit. This radiation-filtering fence 320/330 may be configured as a metal flange having an L-shaped cross-section (see, e.g., FIGS. 3, 4*a*), and may be capacitively coupled to the reflector 110. As shown by FIGS. 4*b* and 5*c*, the radiation-filtering fence may also include a series combination of at least two of: a low-pass LC circuit, a band-pass LC circuit, and a high-pass LC circuit therein. According to some of these embodiments of the invention, a first plurality of segments 341 of the multi-segment fence may be configured as capacitive elements 340 having air-gaps 310 therebetween, a second plurality of segments 341 of the multi-segment fence may be configured as capacitive elements having air-gaps therebetween, and a third plurality of segments 344 of the multi-segment fence may be configured as capacitive elements 342 having meandering-shaped inductive elements 343 therebetween. As shown by FIG. 5*c*, the plurality of segments may be patterned as metallization layers (e.g., 362 (C), 363 (C), 364 (L)) of respective LC circuits/filters 365, 366, on a printed circuit board.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

What is claimed is:

1. A multi-band antenna, comprising:

a reflector;

a plurality of first radiating elements on the reflector, said plurality of first radiating elements configured to radiate a first antenna beam in a first frequency band responsive to at least one feed signal;

a plurality of second radiating elements on the reflector, said plurality of second radiating elements configured to radiate a second antenna beam in a second frequency band, which is higher than the first frequency band; and a passive radiation-filtering element extending adjacent the first radiating elements, said passive radiation-filtering element comprising at least one of a low-pass LC circuit, a band-pass LC circuit, and a high-pass LC circuit therein, which is configured to provide a lower frequency-dependent impedance to radiation within the first frequency band relative to radiation at frequencies outside the first frequency band;

wherein the passive radiation-filtering element extends closer to a rear-facing surface of a first one of the plurality of first radiating elements relative to a forward-facing surface of the first one of the plurality of first radiating elements and is configured as a multi-segment fence having capacitive and inductive elements therein, which are electrically coupled in series;

wherein the multi-segment fence extends adjacent a side of the reflector and is configured as metal flange having an L-shaped cross-section, which is mounted on a forward-facing surface of the reflector;

wherein the plurality of first radiating elements extend between the multi-segment fence and the plurality of second radiating elements;

wherein a first plurality of segments of the multi-segment fence are configured as capacitive elements having air-gaps therebetween;

wherein a second plurality of segments of the multi-segment fence are configured as capacitive elements having air-gaps therebetween; and wherein a third plurality of segments of the multi-segment fence are configured as capacitive elements having meandering-shaped inductive elements therebetween.

2. The antenna of claim 1, wherein the multi-segment fence is capacitively coupled to the reflector.

3. The antenna of claim 1, wherein the third plurality of segments extend between the first plurality of segments and the second plurality of segments.

4. The antenna of claim 3, wherein the first plurality of segments extend to a first end of the multi-segment fence; and wherein the second plurality of segments extend to a second end of the multi-segment fence.

5. The antenna of claim 1, wherein the multi-segment fence comprises a printed circuit board.

6. A multi-band antenna, comprising:

a reflector;

a plurality of first radiating elements on the reflector, said plurality of first radiating elements configured to radiate a first antenna beam in a first frequency band responsive to at least one feed signal; and a passive radiation-filtering element extending adjacent the first radiating elements, said passive radiation-filtering element comprising at least one of a low-pass LC circuit, a band-pass LC circuit, and a high-pass LC circuit therein, which is configured to provide a lower frequency-dependent impedance to radiation within the first frequency band relative to radiation at frequencies outside the first frequency band;

wherein the passive radiation-filtering element is configured as a multi-segment fence, which is configured as a metal flange having an L-shaped cross-section comprising a first segment and an adjoining second segment, with the first segment having capacitive elements and inductive elements therein, which are electrically coupled in series, and the second segment being mounted on a forward-facing surface of the reflector; and wherein the capacitive elements are configured as sub-segments of the first segment and the inductive elements are configured as slots extending between the sub-segments.

7. The multi-band antenna of claim 6, wherein the multi-segment fence is capacitively coupled to the reflector.

8. The multi-band antenna of claim 6, wherein the passive radiation-filtering element extends closer to a rear-facing surface of a first one of the plurality of first radiating elements relative to a forward-facing surface of the first one of the plurality of first radiating elements.

* * * * *